US005352375A

United States Patent [19]

Swan et al.

[11] Patent Number: 5,352,375

[45] Date of Patent: Oct. 4, 1994

[54] AZEOTROPE-LIKE COMPOSITIONS OF 1,1,1,2,2,3,3,-HEPTAFLUOROPENTANE, $C_1$-$C_3$ ALKANOL AND OPTIONALLY NITROMETHANE

[75] Inventors: E. L. Swan, Amherst; David Nalewajek, W. Seneca; L. Ellis, Orchard Park, all of N.Y.

[73] Assignee: AlliedSignal Inc., Morristownship, Morris County, N.J.

[21] Appl. No.: 108,207

[22] Filed: Aug. 17, 1993

[51] Int. Cl.[5] ..... B08B 3/00; C11D 7/30; C11D 7/50; C23G 5/028

[52] U.S. Cl. ..... 252/171; 134/12; 134/31; 134/40; 134/42; 252/153; 252/170; 252/364; 252/DIG. 9

[58] Field of Search ..... 252/162, 170, 171, 364, 252/DIG. 9, 153; 134/12, 31, 40, 42; 8/142

[56] References Cited

U.S. PATENT DOCUMENTS 3,927,129 12/1975 Haszeldine et al. ..... 260/653.1 R
5,219,488 6/1993 Basu et al. ..... 252/171
5,219,489 6/1993 Swan et al. ..... 252/171
5,275,669 1/1994 Van Der Puy et al. ..... 134/42

FOREIGN PATENT DOCUMENTS 432672 12/1990 European Pat. Off. .
0431458 6/1991 European Pat. Off. .
3-252500 11/1991 Japan ..... 252/171
4-28798 1/1992 Japan .
93/09216 5/1993 PCT Int'l Appl. .

OTHER PUBLICATIONS

Giacometti et al, *Canadian Journal of Chemistry* vol. 36 pp. 1493–1500 (1958).

*Primary Examiner*—Linda Skaling
*Attorney, Agent, or Firm*—Karen A. Harding; J. P. Friedenson; C. D. Szuch

[57] ABSTRACT

Stable azeotrope-like compositions of 1,1,1,2,2,3,3-heptafluoropentane, $C_1$–$C_3$ alkanol and optionally nitromethane have been discovered which are useful as degreasing agents and as solvents in a variety of industrial cleaning applications including cold cleaning and defluxing of printed circuit boards and dry cleaning.

16 Claims, No Drawings

AZEOTROPE-LIKE COMPOSITIONS OF 1,1,1,2,2,3,3,-HEPTAFLUOROPENTANE, $C_1$-$C_3$ ALKANOL AND OPTIONALLY NITROMETHANE

BACKGROUND OF THE INVENTION

Vapor degreasing and solvent cleaning with fluorocarbon based solvents have found widespread use in industry for the degreasing and otherwise cleaning of solid surfaces, especially intricate parts and difficult to remove soils.

In its simplest form, vapor degreasing or solvent cleaning consists of exposing at room temperature object(s) to be cleaned to the vapors of a boiling solvent. Vapors condensing on the object provide clean distilled solvent to wash away grease or other contamination. Final evaporation of solvent from the object leaves behind no residue as would be the case where the object is simply washed in liquid solvent.

For difficult to remove soils where elevated temperature is necessary to improve the cleaning action of the solvent, or for large volume assembly line operations where the cleaning of metal parts and assemblies must be done efficiently and quickly, the conventional operation of a vapor degreaser consists of immersing the part to be cleaned in a sump of boiling solvent which removes the bulk of the soil, thereafter immersing the part in a sump containing freshly distilled solvent near room temperature, and finally exposing the part to solvent vapors over the boiling sump which condense on the cleaned part. In addition, the part can also be sprayed with distilled solvent before final rinsing.

Cold cleaning is another application where a number of solvents are used. In most cold cleaning applications, the soiled part is either immersed in the fluid or wiped with cloths or similar objects soaked in solvents and allowed to air dry.

Azeotropic or azeotrope-like compositions are desired because they do not fractionate upon boiling. This behavior is desirable because in the previously described vapor degreasing equipment with which these solvents are employed, redistilled material is generated for final rinse-cleaning. Thus, the vapor degreasing system acts as a still. Unless the solvent composition exhibits a constant boiling point, i.e., is azeotrope-like, fractionation will occur and undesirable solvent distribution may act to upset the cleaning and safety of processing. Preferential evaporation of the more volatile components of the solvent mixtures, which would be the case if they were not azeotrope-like, would result in mixtures with changed compositions which may have less desirable properties, such as lower solvency towards soils, less inertness towards metal, plastic or elastomer components, and increased flammability and toxicity.

Fluorocarbon solvents, such as trichlorotrifluoroethane (CFC-113), have attained widespread use in recent years as effective, nontoxic, and nonflammable agents useful in degreasing applications and other solvent cleaning applications. The art has looked towards azeotrope or azeotrope-like compositions including the desired fluorocarbon components such as CFC-113 and which also include components which contribute additionally desired characteristics, such as polar functionality, increased solvency power, and stabilizers. The art is continually seeking new fluorocarbon based azeotrope-like mixtures which offer alternatives for new and special applications for vapor degreasing and other cleaning applications. Currently, fluorocarbon based azeotrope-like mixtures with minimal or no chlorine are of particular interest because they are considered to be stratospherically safer substitutes for presently used chlorofluorocarbons (CFCs). The latter are suspected of causing environmental problems in connection with the earth's protective ozone layer. Mathematical models have substantiated that hydrofluorocarbons, such as 1,1,1,2,2,3,3-heptafluoropentane (HFC-467mccfs), will not adversely affect atmospheric chemistry since they do not contribute to ozone depletion and contribute only negligibly to global warming in comparison to chlorofluorocarbons such as CFC-113.

DESCRIPTION OF THE INVENTION

The present invention comprises azeotrope-like compositions consisting essentially of 1,1,1,2,2,3,3-heptafluoropentane (HFC-467mccfs), $C_1$–$C_3$ alkanol and optionally nitromethane.

For purposes of this invention, $C_1$–$C_3$ alkanol shall mean methanol, ethanol, isopropanol. Methanol and ethanol are the preferred alkanols.

The present azeotrope-like compositions are advantageous for the following reasons. The HFC-467mccfs component does not deplete ozone and has reasonable solvency characteristics. The alkanol components also have good solvent properties dissolving polar contaminants. Nitromethane adds to the hydrolytic stability of the azeotropic blends in the presence of metals. Thus, when these components are combined in effective amounts, a stable, efficient azeotrope-like solvent results.

The preferred, more preferred and most preferred embodiments for each azeotrope-like composition of the invention are set forth in Table I below. The numerical ranges, boiling point and pressures are understood to be prefaced by "about".

TABLE I

| COMPONENTS | PREFERRED RANGE (WT. %) | MORE PREFERRED RANGE (WT. %) | MOST PREFERRED RANGE (WT. %) | BOILING POINT (°C.) |
|---|---|---|---|---|
| HFC-467 mccfs | 99.2–74 | 99.2–84.5 | 99–91.7 | 35 @ 754 mm Hg |
| Methanol | 0.8–25 | 0.8–15 | 1–8 | |
| Nitromethane | 0–1.0 | 0–0.5 | 0–0.3 | |
| HFC-467 mccfs | 99.9–94 | 99.9–96.5 | 99.5–97.7 | 38 @ 749 mm Hg |
| Ethanol | 0.1–5 | 0.1–3 | 0.5–2 | |
| Nitromethane | 0–1.0 | 0–0.5 | 0–0.3 | |
| HFC-467 mccfs | 99.9–96 | 99.5–97 | 99.5–97.7 | 40 @ 749 mm Hg |
| Isopropanol | 0.1–3 | 0.5–2.5 | 0.5–2 | |

TABLE I-continued

| COMPONENTS | PREFERRED RANGE (WT. %) | MORE PREFERRED RANGE (WT. %) | MOST PREFERRED RANGE (WT. %) | BOILING POINT (°C.) |
|---|---|---|---|---|
| Nitromethane | 0–1.0 | 0–0.5 | 0–0.3 | |

All compositions within the indicated ranges, as well as certain compositions outside the indicated ranges, are azeotrope-like, as defined more particularly below.

The precise azeotrope compositions have not been determined but have been ascertained to be within the above ranges. Regardless of where the true azeotropes lie, all compositions within the indicated ranges, as well as certain compositions outside the indicated ranges, are azeotrope-like, as defined more particularly below.

The term "azeotrope-like composition" as used herein is intended to mean that the composition behaves like an azeotrope, i.e. has constant-boiling characteristics or a tendency not to fractionate upon boiling or evaporation. Thus, in such compositions, the composition of the vapor formed during boiling or evaporation is identical or substantially identical to the original liquid composition. Hence, during boiling or evaporation, the liquid composition, if it changes at all, changes only to a minimal or negligible extent. This is contrasted with non-azeotrope-like compositions in which the liquid composition changes substantially during boiling or evaporation.

As is readily understood by persons skilled in the art, the boiling point of the azeotrope-like composition will vary with the pressure.

The azeotrope-like compositions of the invention are useful as solvents in a variety of vapor degreasing, cold cleaning and solvent cleaning applications including defluxing and dry cleaning.

In the process embodiment of the invention, the azeotrope-like compositions of the invention may be used to clean solid surfaces by treating said surfaces with said compositions in any manner well known to the art such as by dipping or spraying or use of conventional degreasing apparatus. Preferably, the azeotrope-like compositions of the invention are used to dissolve contaminants or remove contaminants from the surface of a substrate by treating the surface with the compositions in any manner well known to the art such as by dipping or spraying or use of conventional degreasing apparatus wherein the contaminants are substantially dissolved or removed.

HFC-467mccfs is not commercially available.

EXAMPLE 1

This example is directed to the preparation of 1,1,1,2,2,3,3-heptafluoropentane.

A glass lined 600-mL autoclave containing 3,3,4,4,5,5,5-heptafluoropentane (32.49 g, 0.166 mol) and 0.5% $Pd/Al_2O_3$ (3.53 g) was charged with 900 psi $H_2$ at 25° C. Reaction was immediate and moderately exthermic; the observed pressure decrease was 175 psi over 30 minutes. The mixture was stirred at 25° C. for 22 h, then cooled to 20° C. and vented. The liquid product was filtered through Celite and distilled on a 6" packed column (bp 40.0°–40.5° C.; ref bp 41° C.) to afford 21.95 g of 98.7% (GC) 1,1,1,2,2,3,3-heptafluoropentane (0.111 mol, 66.7%).

EXAMPLES 2–4

The range over which the following compositions exhibit constant boiling behavior was determined using ebulliometry:

a) HFC-467mccfs/methanol;
b) HFC-467mccfs/ethanol;
c) HFC-467mccfs/isopropanol;

The ebulliometer consisted of a heated sump. The upper part of the ebulliometer connected to the sump was cooled thereby acting as a condenser for the boiling vapors, allowing the system to operate at total reflux. Measured quantities of HFC-467mccfs were charged into an ebulliometer and brought to a boil. After bringing the HFC-467mccfs to a boil at atmospheric pressure, measured amounts of a specific $C_1$–$C_3$ alcohol was titrated into the ebulliometer. The change in boiling point was measured with a platinum resistance thermometer.

The results indicate that the following compositions are azeotropic or constant boiling at the stated temperatures at 760 mm Hg:

a) about 75/25 weight percent HFC-467mccfs/methanol at about 35°±0.5° C.;
b) about 95/5 weight percent HFC-467mccfs/ethanol at about 39°±0.5° C.;
c) about 97/3 weight percent HFC-467mccfs/isopropanol at about 40°±0.5° C.

EXAMPLES 5–7

The experiment outlined in Examples 2–4 above is repeated for the following compositions. HFC-467mccfs and the alkanol are changed to the ebulliometer first followed by nitromethane.

a) HFC-467 mccfs/methanol/nitromethane;
b) HFC-467mccfs/ethanol/nitromethane;
c) HFC-467mccfs/isopropanol/nitromethane.

The results indicate that the following compositions are azeotrope-like at 760 mm Hg at the stated temperatures:

a) about 74/25/1 weight percent HFC-467mccfs/methanol/nitromethane at about 35°±0.5° C.;
b) about 94/5/1 weight percent HFC-467mccfs/ethanol/nitromethane at about 39°±0.5° C.;
c) about 94/5/1 weight percent HFC-467mccfs/isopropanol/nitromethane at about 40°±0.5° C.

EXAMPLES 8 THROUGH 13

Performance studies are conducted wherein metal coupons are cleaned using the present azeotrope-like compositions as solvents. The metal coupons are soiled with various types of oils.

A small test tube with condensing coils near its lip is used. Each azeotrope-like composition is boiled in the test tube and condenses on the coils providing a vapor. The condensed solvent then drips back into the test tube.

The metal coupons are held in the solvent vapor and then vapor rinsed for a period of 10 to 30 seconds depending upon the oils selected. The azeotrope-like compositions of Examples 2 through 7 are used as the solvents. Cleanliness (i.e. total residual materials left after cleaning) of the coupons is determined by carbon coulometry. The results indicate that the compositions of Examples 2 through 7 are effective solvents, removing substantially all of the soil from the coupons.

EXAMPLE 14 THROUGH 19

Each solvent of Examples 2 through 7 above is added to mineral oil in a weight ratio of 50/50 at about 25° C. Each solvent is miscible in the mineral oil.

EXAMPLES 20 THROUGH 25

Metal coupons are soiled with various types of oil. The soiled metal coupons are sprayed with the solvents of Examples 2 through 7 above and allowed to air dry. Upon visual inspection, the soil appears to be substantially removed.

Known additives may be used in the present-azeotrope-like compositions in order to tailor the composition for a particular use. Inhibitors may be added to the present azeotrope-like compositions to inhibit decomposition of the compositions; react with undesirable decomposition products of the compositions; and/or prevent corrosion of metal surfaces. Any or all of the following classes of inhibitors may be employed in the invention: alkanols having 4 to 7 carbon atoms, nitroalkanes having 1 to 3 carbon atoms, 1,2-epoxyalkanes having 2 to 7 carbon atoms, phosphite esters having 12 to 30 carbon atoms, straight chain ethers having 3 or 4 carbon atoms, unsaturated compounds having 4 to 6 carbon atoms, including diol compound such as 1,4-butyne diol, 1,5-pentyne diol and 1,6 hexyne diol, acetals having 4 to 7 carbon atoms, ketones having 3 to 5 carbon atoms, and amines having 6 to 8 carbon atoms. Other suitable inhibitors will readily occur to those skilled in the art. The inhibitors may be used alone or in mixtures thereof in any proportions. Typically, up to about 2 percent based on the total weight of the azeotrope-like composition of inhibitor might be used.

In spraying applications, the azeotrope-like compositions may be sprayed onto a surface by using a propellant. Suitable propellants include chlorofluorocarbons like dichlorodifluoromethane, hydrofluorocarbons like 1,1,1,2-tetrafluoroethane (HFC- 134a), ethers like dimethyl ether and hydrocarbons like butane and isobutane.

What is claimed is:

1. Azeotrope-like compositions consisting essentially of 1,1,1,2,2,3,3-heptafluoropentane, a second component selected from the group consisting of methanol, ethanol and isopropanol and optionally nitromethane as a third component; wherein said compositions of 1,1,1,2,2,3,3-heptafluoropentane, methanol and optionally nitromethane consist essentially of from about 99.2 to about 74 weight percent 1,1,1,2,2,3,3,-heptafluoropentane; from about 0.8 to about 25 weight percent methanol and from about 0 to about 1.0 weight percent nitromethane, which boil at about 35° C. at about 754 mm Hg;

said compositions of 1,1,1,2,2,3,3,-heptafluoropentane, ethanol and optionally nitromethane consist essentially of about 99.9 to about 94 weight percent 1,1,1,2,2,3,3,-heptafluoropentane, about 0.1 to about 5 weight percent ethanol and from about 0 to about 1.0 weight percent nitromethane which boil at about 38° C. at about 749 mm Hg; and said compositions of 1,1,1,2,2,3,3,-heptafluoropentane, isopropanol and optionally nitromethane consist essentially of about 99.9 to about 96 weight percent 1,1,1,2,2,3,3,-heptafluoropentane, from about 0.1 to about 3.0 weight percent isopropanol and from about 0 to about 1.0 weight percent nitromethane which boil at about 40° C. at about 749 mm Hg.

2. The azeotrope-like compositions of claim 1 wherein said compositions consist essentially of from about 84.5 to about 99.2 weight percent 1,1,1,2,2,3,3-heptafluoropentane, from about 0.8 to about 15 weight percent methanol and from about 0 to about 0.5 weight percent nitromethane.

3. The azeotrope-like compositions of claim 1 wherein said compositions consist essentially of from about 91.7 to about 99 weight percent 1,1,1,2,2,3,3-heptafluoropentane, from about 1 to about 8 weight percent methanol and from about 0 to about 0.3 weight percent nitromethane.

4. The azeotrope-like compositions of claim I wherein said compositions consist essentially of from about 96.5 to about 99.9 weight percent 1,1,1,2,2,3,3-heptafluoropentane and from about 0.1 to about 3.0 weight percent ethanol and from about 0 to about 0.5 weight percent nitromethane.

5. The azeotrope-like compositions of claim 1 wherein said compositions consist essentially of from about 99.5 to about 97.7 weight percent 1,1,1,2,2,3,3-heptafluoropentane, from about 0.5 to about 2.0 weight percent ethanol and from about 0 to about 0.3 weight percent nitromethane.

6. The azeotrope-like compositions of claim 1 wherein said compositions consist essentially of from about 97 to about 99.5 weight percent 1,1,1,2,2,3,3-heptafluoropentane and from about 0.5 to about 2.5 weight percent isopropanol and from about 0 to about 0.5 weight percent nitromethane.

7. The azeotrope-like compositions of claim 1 wherein said compositions consist essentially of from about 97.7 to about 99.5 weight percent 1,1,1,2,2,3,3-heptafluoropentane, from about 0.5 to about 2.0 weight percent isopropanol and from about 0 to about 0.3 weight percent nitromethane.

8. The azeotrope-like compositions of claim 1 further including an inhibitor in an amount effective to accomplish at least one of the following: inhibit decomposition of the compositions; react with undesirable decomposition products of the compositions; and prevent corrosion of metal surfaces.

9. The azeotrope-like compositions of claim 1 wherein said inhibitor is selected from the group consisting of alkanols having 4 to 7 carbon atoms, 1,2-epoxyalkanes having 2 to 7 carbon atoms, phosphite esters having 12 to 30 carbon atoms, aliphatic, single ethers having 3 or 4 carbon atoms, alkyne diols having 4 to 6 carbon atoms, acetals having 4 to 7 carbon atoms, ketones having 3 to 5 carbon atoms, and amines having 6 to 8 carbons atoms.

10. A method of cleaning a solid surface comprising treating said surface with an azeotrope-like composition of claim 1.

11. A method of cleaning a solid surface comprising treating said surface with an azeotrope-like composition of claim 2.

12. A method of cleaning a solid surface comprising treating said surface with an azeotrope-like composition of claim 3.

13. A method of cleaning a solid surface comprising treating said surface with an azeotrope-like composition of claim 4.

14. A method of cleaning a solid surface comprising treating said surface with an azeotrope-like composition of claim 5.

15. A method of cleaning a solid surface comprising treating said surface with an azeotrope-like composition of claim 6.

16. A method of cleaning a solid surface comprising treating said surface with an azeotrope-like composition of claim 7.

* * * * *